US011710608B2

(12) United States Patent
Zhang et al.

(10) Patent No.: US 11,710,608 B2
(45) Date of Patent: Jul. 25, 2023

(54) ILLUMINATED PUSH-BUTTON SWITCH DEVICE

(71) Applicant: ALPS ALPINE CO., LTD., Tokyo (JP)

(72) Inventors: Guoqiang Zhang, Dalian (CN); Qiannan Lu, Dalian (CN)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 17/238,645

(22) Filed: Apr. 23, 2021

(65) Prior Publication Data

US 2021/0241983 A1 Aug. 5, 2021

Related U.S. Application Data

(63) Continuation of application No. PCT/JP2019/042622, filed on Oct. 30, 2019.

(30) Foreign Application Priority Data

Oct. 31, 2018 (CN) ..... 201811284417.X

(51) Int. Cl.
*H01H 13/02* (2006.01)
*H01H 13/14* (2006.01)
*H01H 13/44* (2006.01)

(52) U.S. Cl.
CPC ..... *H01H 13/023* (2013.01); *H01H 13/14* (2013.01); *H01H 13/44* (2013.01)

(58) Field of Classification Search
CPC ..... H01H 13/023; H01H 13/14; H01H 13/44; H01H 13/02; H01H 13/04; H01H 13/83;
(Continued)

(56) References Cited

U.S. PATENT DOCUMENTS 6,984,797 B2 * 1/2006 Morita ..... H01H 3/122 200/344
8,723,062 B2 * 5/2014 Chen ..... H01H 13/83 200/314

(Continued)

FOREIGN PATENT DOCUMENTS

CN 101627255 1/2010
JP 2005-285736 10/2005

(Continued)

OTHER PUBLICATIONS

International Search Report for PCT/JP2019/042622 dated Dec. 10, 2019.
Chinese Office Action for 201811284417.X dated Feb. 14, 2022.

*Primary Examiner* — Lheiren Mae A Caroc
(74) *Attorney, Agent, or Firm* — IPUSA, PLLC

(57) ABSTRACT

The illuminated push-button switch device includes a shell-portion enclosing a switch element and a light source and having one or more opening-portions protruding from an upper surface of the shell-portion; a button-portion provided to cover the opening-portions, the button-portion being vertically movable along the opening-portions; and a panel-portion surrounding an outside of the button-portion and provided on the upper surface of the shell-portion, wherein gap is provided between the panel-portion and the button-portion in a top view, wherein the upper surface of the shell-portion extends along a plane perpendicular to a vertical movement direction of the button-portion, and a slope-portion at a predetermined angle with respect to the upper surface is formed on a portion of the upper surface situated under the gap, and wherein a height of the slope-portion along the vertical movement direction gradually decreases from a button-portion side to a panel portion side.

4 Claims, 14 Drawing Sheets

(58) Field of Classification Search
CPC ..... H01H 13/10; H01H 13/06; H01H 13/12; H01H 13/70; H01H 13/86
USPC ..... 200/314, 341, 344, 345
See application file for complete search history.

(56) References Cited

U.S. PATENT DOCUMENTS

| | | | | |
|---|---|---|---|---|
| 2005/0006215 | A1* | 1/2005 | Sasaki ..... | H01H 25/041 200/344 |
| 2005/0189205 | A1 | 9/2005 | Fujii et al. | |

FOREIGN PATENT DOCUMENTS

| | | |
|---|---|---|
| JP | 2012-204045 | 10/2012 |
| JP | 2013-062124 | 4/2013 |

* cited by examiner

ILLUMINATED PUSH-BUTTON SWITCH DEVICE

CROSS-REFERENCE TO RELATED APPLICATIONS

This U.S. non-provisional application is a continuation of PCT International Application PCT/JP2019/042622 filed on Oct. 30, 2019 and designated the U.S., which is based on and claims priority to Chinese Patent Application No. 201811284417.X filed with the State Intellectual Property Office of China on Oct. 31, 2018, and the entire contents of Chinese Patent Application No. 201811284417.X are incorporated by reference in this international application.

BACKGROUND OF THE INVENTION

1. Field of the Invention

The present invention relates to an illuminated push-button switch device which illuminates the top of the push-button by a light source provided within the push-button.

2. Description of the Related Art

As light emitting diode (LED) sources have become widely used in recent years, illuminated push button switches are used as the push-button switches in many electronic devices. In the field of automotive interior decoration, illuminated push-button switch devices are often used, for example, push-buttons in the window operation panels and push-buttons in the central operation panels.

Hereinafter, a conventional illuminated push-button switch device 900 will be described with reference to FIGS. 1 to 3.

FIG. 1 is a perspective view of a conventional illuminated push-button switch device 900. FIG. 2 is an exploded perspective view of each component included in the conventional illuminated push-button switch device 900.

As illustrated in FIG. 1, the illuminated push-button switch device 900 includes two illuminated button portions 901 that are provided side by side on a shell portion 902. A panel portion 903 is further provided on the shell portion 902, and the panel portion 903 surrounds the two button portions 901. A predetermined gap between the panel portion 903 and the button portions 901 is provided.

As illustrated in FIG. 2, the shell portion 902 has a plurality of opening portions 904 protruding from the upper surface of the shell portion 902. Each of the button portions 901 is provided to cover a respective opening portion 904 and can move up and down along the respective opening portion 904. The panel portion 903 is mounted, for example, on the upper surface of the shell portion 902 in a locking manner. A generally flat rubber component 905, a circuit board 906, and a bottom cover 907 are stored within the downwardly open gap of the shell portion 902 in this order. The circuit board 906 is provided with two light sources 909 corresponding to the two respective button portions 901.

FIG. 3 is a cross-sectional view taken along the plane A in FIG. 1. As illustrated in FIG. 3, the button portions 901 is formed by a translucent material, and includes a substantially inverted U-shaped operating portion 901*a* and a slide wall 901*b* extending downwardly from the operating portion 901*a*. A light shielding layer 910 is formed on almost the entire surface of the operating portion 901*a* of the button portion 901. Also, by removing a portion of the light shielding layer 910 using a technique such as laser machining, a pattern (not illustrated) such as numbers, letters, or figures is further provided in the operating portion 901*a*. These patterns (not illustrated) are capable of transmitting light from the light source 909 because the light shielding layer 910 is not formed thereon.

As illustrated in FIG. 3, when the light source 909 emits light, of the light emitted, the light L1 is emitted to the surface of the operating portion 901*a* and is transmitted through the pattern (not illustrated) and is then emitted to the exterior of the illuminated push-button switch device 900. Of the light emitted, the light L2 is absorbed by the light shielding layer 910. Of the light emitted, the light L3 that is not absorbed by the light shielding layer 910 is reflected by the light shielding layer 910 and the upper surface 912 of the shell portion 902, and is then emitted from the gap between the panel portion 903 and the button portion 901.

However, when the light emitted from the panel portion 903 and the button portion 901 (light leakage) exceeds a predetermined value, the aesthetics of the entire illuminated push-button switch device 900 may be affected.

SUMMARY OF THE INVENTION

The present invention has been made in view of such problems of the related art, and an object of the present invention is to provide an illuminated push-button switch device capable of reducing light leakage between a panel portion and button portions.

In one aspect of the present invention to solve the problem, an illuminated push-button switch device is provided. The illuminated push-button switch device includes a shell portion enclosing a switch element and a light source and having one or more opening portions protruding from an upper surface of the shell portion; a button portion provided to cover the opening portions, the button portion being vertically movable along the opening portions; and a panel portion surrounding an outside of the button portion and provided on the upper surface of the shell portion, wherein gap is provided between the panel portion and the button portion in a top view, wherein the upper surface of the shell portion extends along a plane perpendicular to a vertical movement direction of the button portion, and a slope portion at a predetermined angle with respect to the upper surface is formed on a portion of the upper surface situated under the gap, and wherein a height of the slope portion along the vertical movement direction gradually decreases from a button portion side to a panel portion side.

With the configuration of the illuminated push-button switch device, when light reflected by the light shielding layer of the button portion is emitted to the upper surface of the shell portion, the light is reflected by the slope portion and then is emitted to an inner wall of the panel portion, not to the gap between the panel portion and the button portion. In other words, the light emitted direction that would otherwise leak from the gap between the panel portion and the button portion can be inclined toward the panel portion by providing such a slope portion. After such light is reflected by the inner wall of the panel portion several times, the amount of light emitted from the gap can be significantly reduced. This greatly reduces the light leakage from the gap between the panel portion and the button portion, thereby improving the aesthetic properties of the illuminated push-button switch device.

In the illuminated push-button switch device, the panel portion and the shell portion are formed by shaping an opaque material.

With the configuration of the illuminated push-button switch device, the illuminated push-button switch device can prevent light from a light source from leaking through the panel portion or shell portion. Furthermore, light emitted to the panel portion, after being reflected by the slope portion, is reflected several times by the inner wall formed of the opaque material, with some light being absorbed each time the light is reflected. Therefore, the light emitted from the gap between the panel portion and the button portion further can be reduced.

In addition, in the illuminated push-button switch device, in the upper view, the slope portion is formed to surround the opening portion, and at least a part of the slope portion is positioned directly under the gap.

The majority of the light leaking from the gap between the panel portion and the button portion is reflected by a portion of the upper surface of the shell portion positioned directly under the gap and is then directly emitted from the gap. By placing the slope portion directly under the gap, the reflected light can be emitted more efficiently at an oblique angle and the light leakage from the gap between the panel portion and the button portion can be more reliably reduced.

In the illuminated push-button switch device, the gap is positioned between the outer wall of the button portion and the inner wall of the panel portion facing the outer wall of the button portion. In the cross-sectional view of the outer wall and the inner wall, an angle between the slope portion and the upper surface is defined as a first angle. An angle between a direction of a straight line (tangent) that comes into contact with the inner wall via a lowermost end of the outer wall and the vertical direction perpendicular to the upper surface is defined as a second angle. A degree of angle in the first angle is equal to or greater than that of the second angle.

When the slope portion is not placed, among the light fluxes that can be directly emitted from the gap after being reflected by the upper surface of the shell portion, the light flux having the maximum angle of reflection (hereinafter referred to as "the maximum angle of reflection of light flux") is a light flux in a direction of a straight line (tangent) that comes into contact with the inner wall of the panel portion via the lowermost end of the outer wall of the button portion (also referred to as "the maximum angle of emission of light flux"). When the angle of reflection of the light flux is less than or equal to the angle of reflection of the maximum angle of reflection of light flux (also referred to as the "maximum angle of reflection"), the light flux may be emitted from the gap. Conversely, when the angle of reflection of the light flux is greater than the angle of reflection of the maximum angle of reflection light flux, the light flux cannot be emitted from the gap.

When the slope portion is placed and the degree of angle in the first angle is equal to or greater than that of the second angle, as can be seen from the geometric relationship, the angle at which the angle of reflection increases when the light flux from the button portion is reflected by the slope portion is equal to or greater than the maximum angle of reflection. Therefore, the angle of reflection of these light fluxes is larger than the maximum angle of reflection. Accordingly, the light flux that comes from the button portion side and is reflected by the slope portion cannot be directly emitted from the gap. This ensures that the reflected light can be reflected to the maximum extent to the opaque area other than the gap.

In the illuminated push-button switch device, the slope portion protrudes from or is recessed from the upper surface.

Thus, when the wall thickness of the upper surface of the shell portion does not have enough thickness, the slope portion may be provided in a protruding shape from the upper surface. When the wall thickness of the upper surface of the shell portion has enough thickness, the slope portion may be provided in a shape recessed from the upper surface. In addition, when a slope portion having a protruded shape is provided, interference with the lower end of the button portion may occur, and this may affect the sliding of the button portion. In such a case, the slope portion is preferably in the form of a recessed shape.

In the illuminated push-button switch device, the slope portion is integrally shaped with the shell portion.

This allows the shell portion to be formed at the same time as the slope portion, thereby avoiding complications in the machining process.

An illuminated push-button switch device according to one aspect of the present invention significantly reduces light leakage from the gap between the panel portion and the button portion, thereby improving the aesthetic properties of the illuminated push-button switch device.

DETAILED DESCRIPTION OF THE INVENTION

Hereinafter, a preferred embodiment for carrying out the invention will be described in detail with reference to the accompanying drawings.

EXAMPLES

The present embodiment will be described in detail below with reference to FIGS. 4 to 12.

First, the entire configuration of an illuminated push-button switch device 100 according to the present embodiment will be described with reference to FIGS. 4 and 5.

Figure 1:
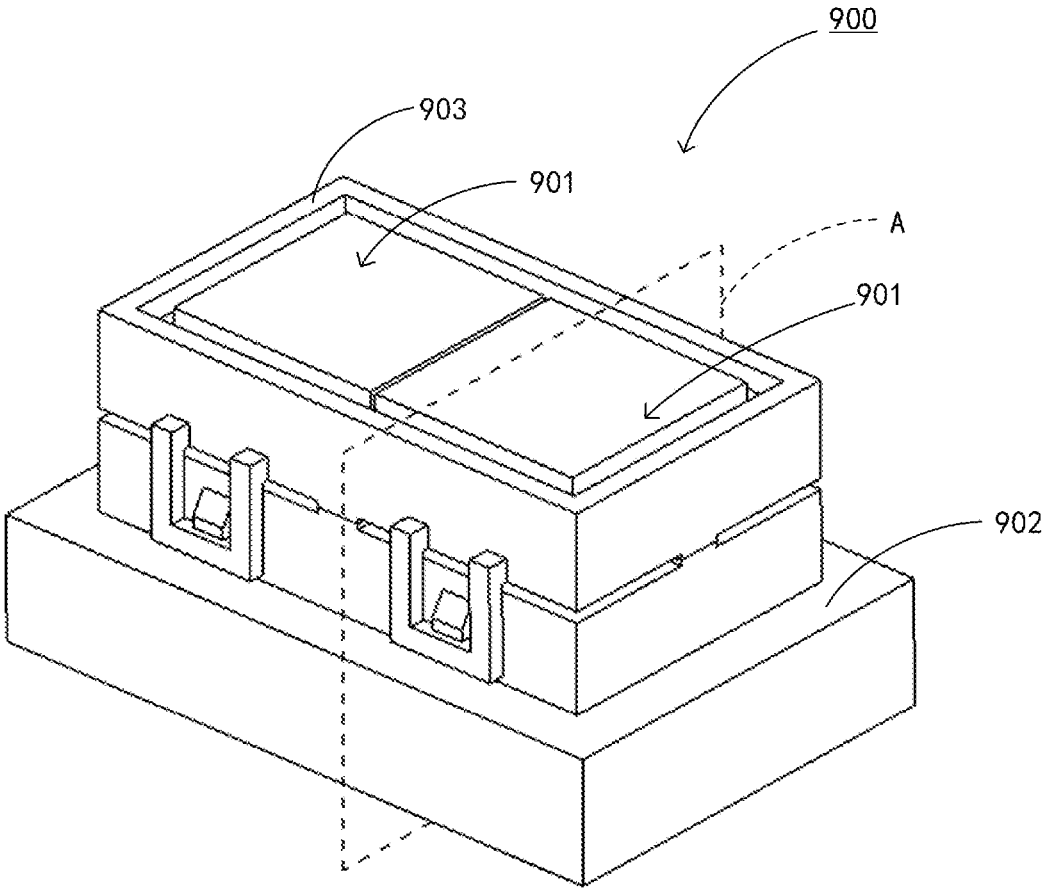
FIG.1 PRIOR ART
FIG. 1 is a perspective view illustrating the appearance of a conventional illuminated push-button switch device.
Figure 2:
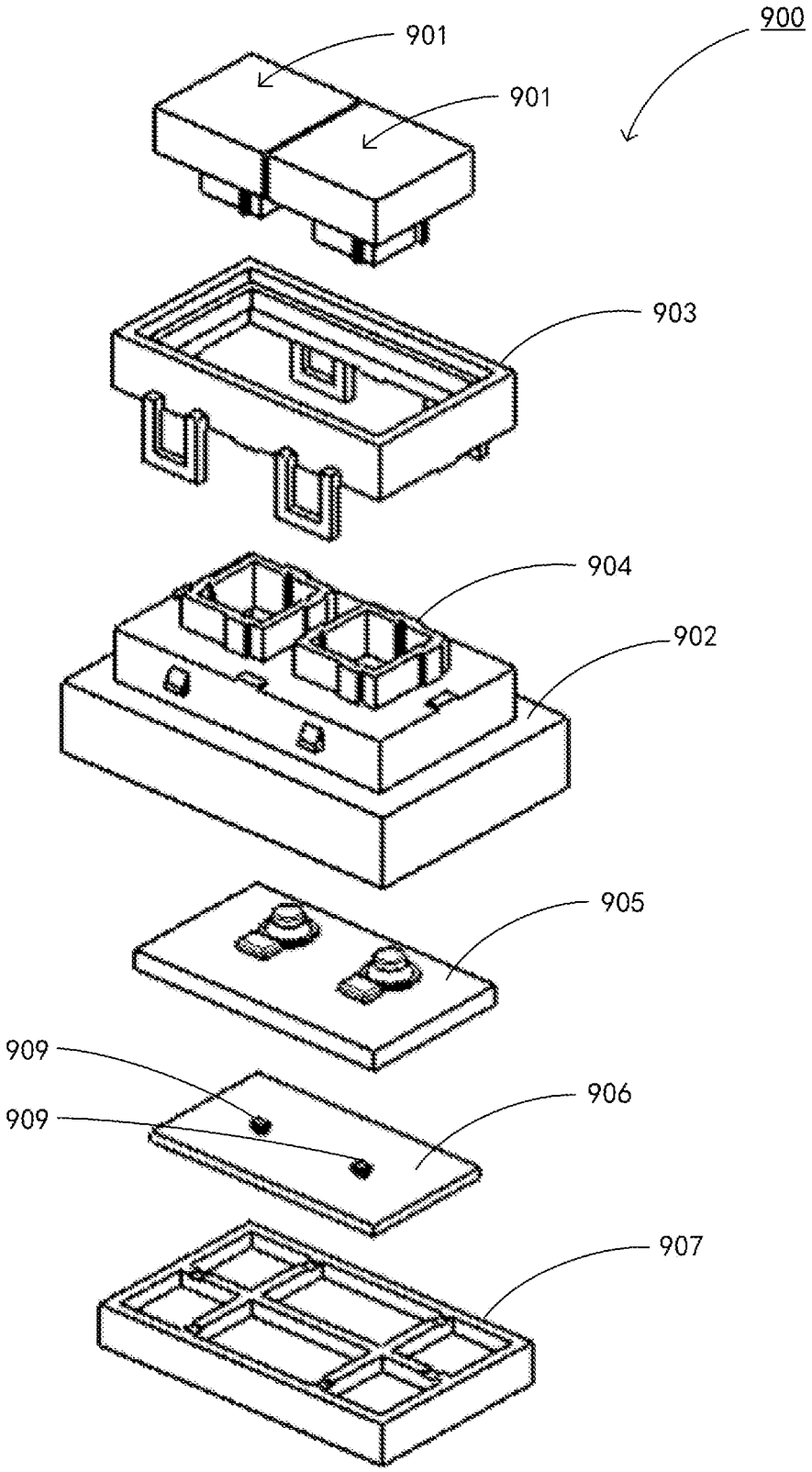
FIG.2 PRIOR ART
FIG. 2 is an exploded perspective view of each component of a conventional illuminated push-button switch device.
Figure 3:
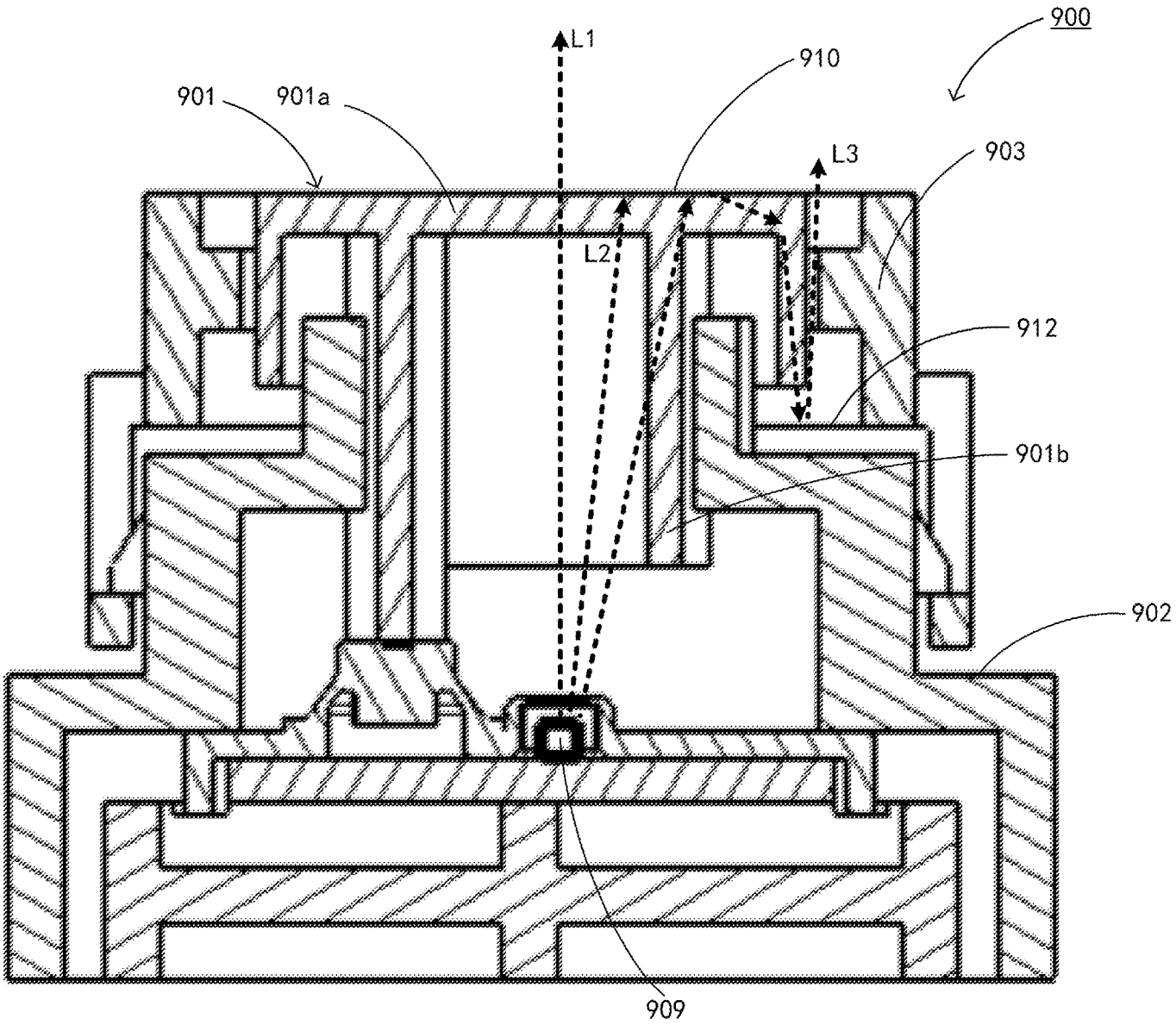
FIG.3 PRIOR ART
FIG. 3 is a cross-sectional view taken along a plane A in FIG. 1.
Figure 4:
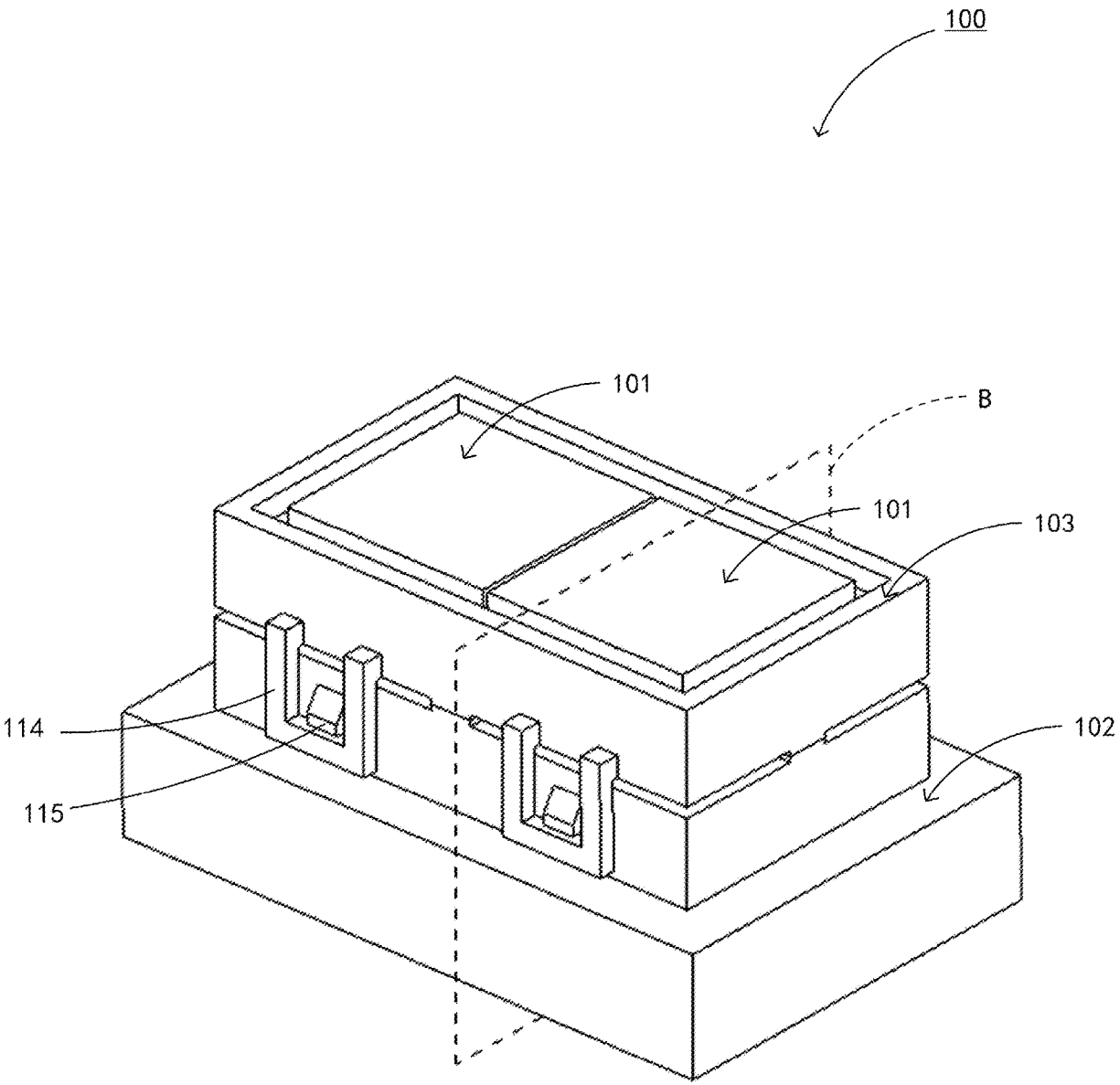
FIG. 4 is a perspective view illustrating the appearance of an illuminated push-button switch device in one embodiment.

FIG. 4 is a perspective view illustrating the appearance of the illuminated push-button switch device 100 according to the present embodiment. FIG. 5 is a top view of the illuminated push-button switch device 100 according to the present embodiment. FIG. 6 is an exploded perspective view illustrating each component of the illuminated push-button switch device 100 according to the present embodiment. The appearance of the illuminated push-button switch device 100 in the present embodiment is the same as that of a conventional illuminated push-button switch device 900 illustrated in FIG. 1, but for convenience of description, the symbols of the illuminated push-button switch device 100 in the drawings are different from the symbols of the conventional illuminated push-button switch device 900.

As illustrated in FIG. 4, the illuminated push-button switch device 100 includes two independent button portions 101 that are positioned side by side on a shell portion 102. A panel portion 103 is further provided on the shell portion 102, and the panel portion 103 surrounds the two button portions 101 from the periphery.

Figure 5:
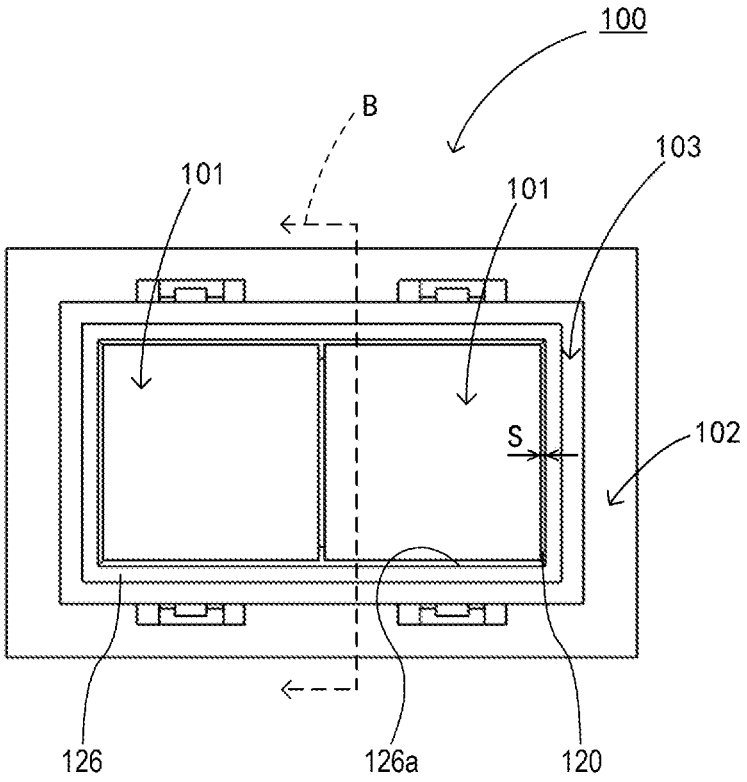
FIG. 5 is a top view of an illuminated push-button switch device in one embodiment.
Figure 6:
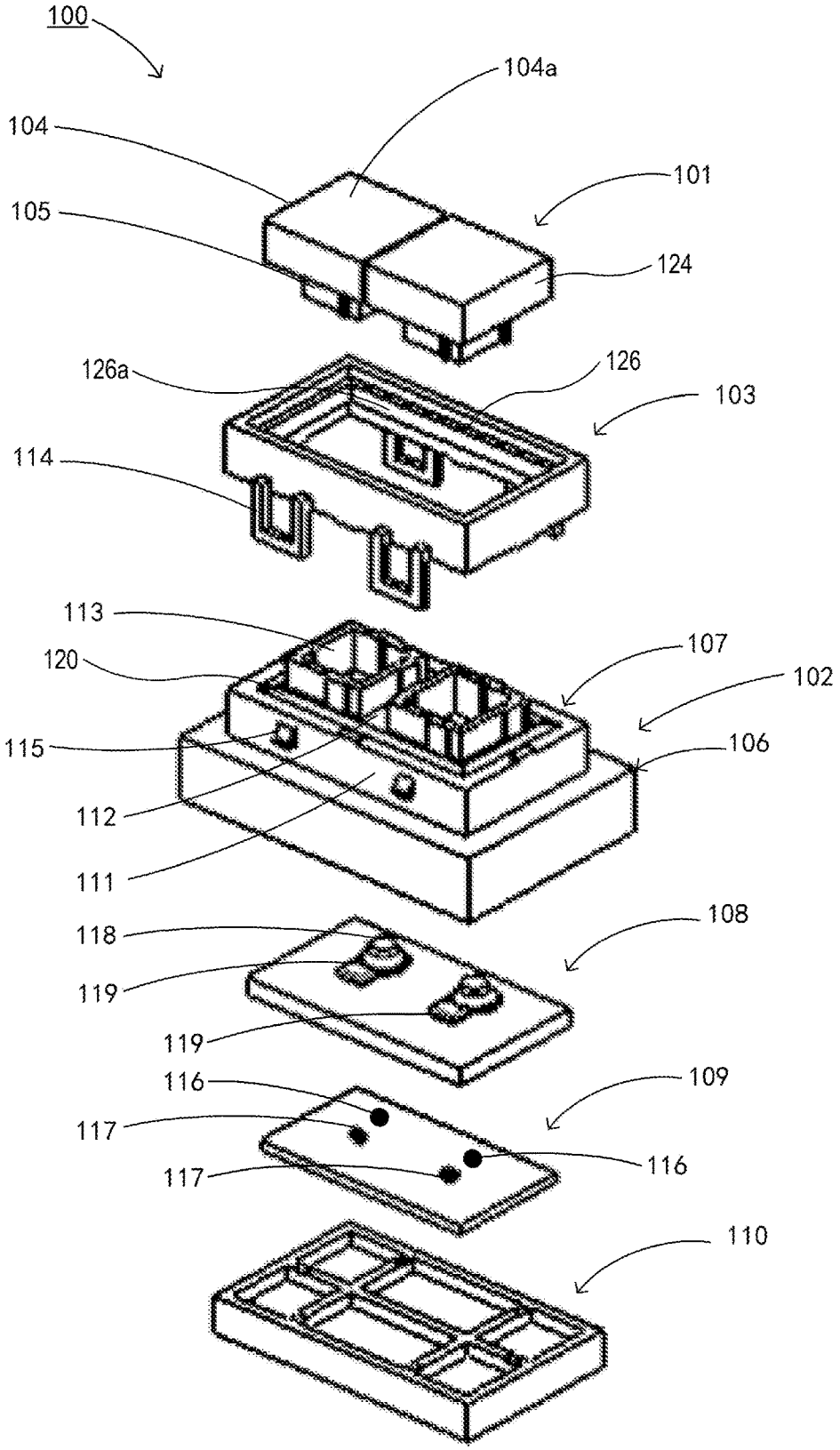
FIG. 6 is an exploded perspective view of each component of an illuminated push-button switch device in one embodiment.

As illustrated in FIG. 5, in the top view, the outer edges of the two button portions 101 is formed to be a square shape (also referred to as a "substantially square shape"), and the panel portion 103 is formed to be a substantially square-shaped band around the two button portions 101. There is a predetermined gap S between the inner edge of the panel portion 103 and the outer edge of the button portion 101. In addition, there is a predetermined gap between each of the button portions 101 that exist individually.

The button portion 101 is formed of a translucent synthetic resin. As illustrated in FIG. 6, each button portion 101 has an operating portion 104 for hand operation and an extending portion 105 extending downwardly from the operating portion 104.

The shell portion 102 is formed of an opaque synthetic resin. As illustrated in FIG. 6, the shell portion 102 includes a base portion 106 and a convex base portion 107 that are integrally shaped, and the convex base portion 107 protrudes above the base portion 106.

The base portion 106 is formed into a cover shape that opens downwardly, and a substantially flat plate-like rubber component 108, a circuit board 109, and a bottom cover 110 are housed within the base portion 106 in order from top to bottom.

The convex base portion 107 is positioned directly under the panel 103' and has a substantially square shape in the top view. The convex base portion 107 includes a side wall 111 and a top wall 112, and the top wall 112 includes two opening portions 113 protruding from the top wall 112 and the two opening portions 113 vertically extend from the top wall 112. In the vertical direction, the two button portions 101 each face toward the two opening portions 113.

The panel portion 103 is formed of an opaque synthetic resin. As illustrated in FIG. 6, a plurality of substantially door-shaped locking portions 114 extending downwardly are provided on the side wall of the panel portion 103. A plurality of locking protrusions 115 are provided on the side wall 111 of the convex base portion 107 corresponding to a plurality of locking portions 114. As illustrated in FIG. 4, the panel portion 103 and the shell portion 102 can be assembled with the locking portions 114 and the locking protrusions 115 as a locking configuration being engaged with each other.

As illustrated in FIG. 6, two switch elements 116 and two substantially-rectangular light sources 117 are provided on the circuit board 109 corresponding to two button portions 101. The rubber component 108 is provided with two upwardly protruding frustum-shaped movable contacts 118 corresponding to two switch elements 116 and two upwardly protruding substantially rectangular light source covers 119 corresponding to two light sources 117.

The circuit board 109 and the rubber component 108 are sequentially laminated onto a synthetic resin bottom cover 110. The bottom cover 110 seals the base portion 106 from below. The bottom cover 110 and the base portion 106 are secured together by screws not illustrated.

Figure 7:
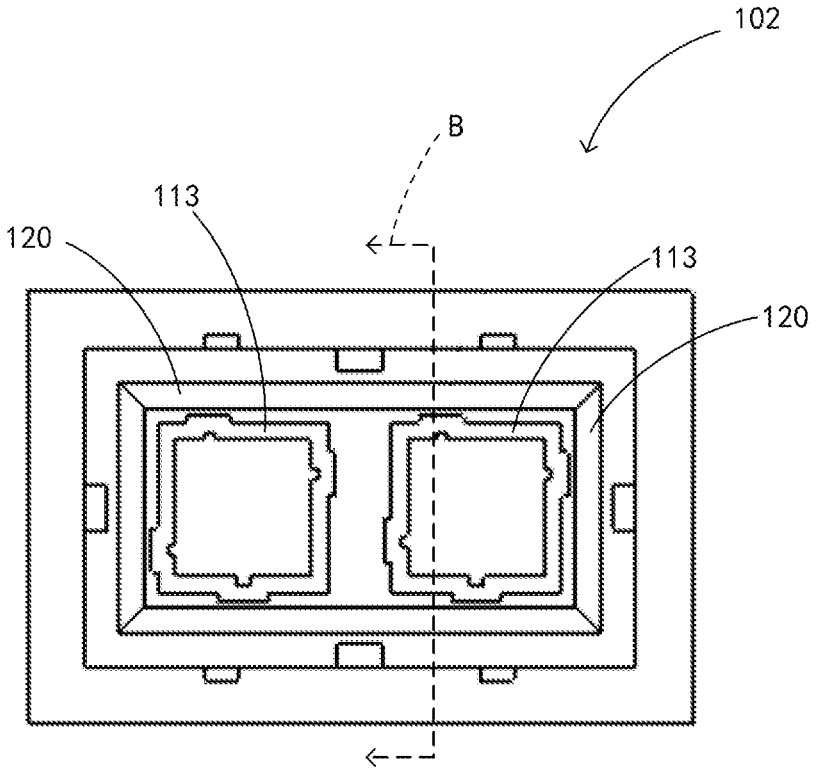
FIG. 7 is a top view of a shell portion in one embodiment.

Next, the structure of the shell portion 102 will be further described with reference to FIGS. 7 and 8. FIG. 7 is a top view of the shell portion 102, and FIG. 8 is a cross-sectional view taken along plane B in FIG. 7.

Figure 8:
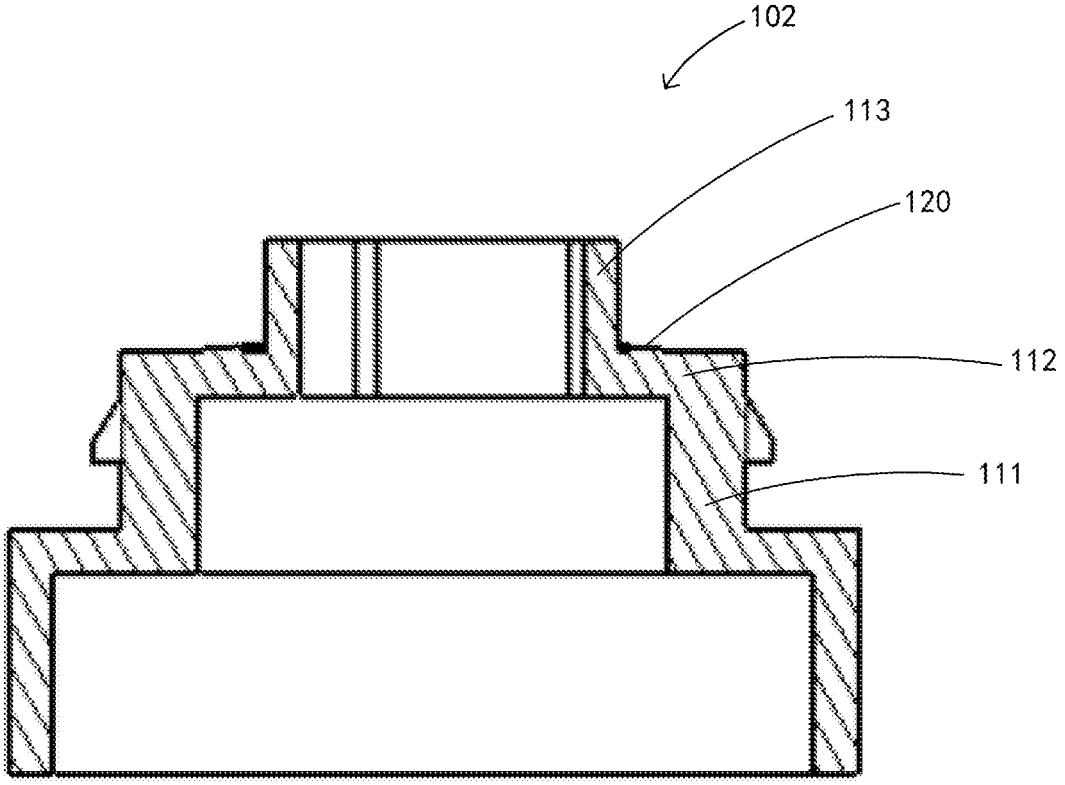
FIG. 8 is a cross-sectional view taken along plane B in FIG. 7.

As illustrated in FIG. 8, the upper surface of the top wall 112 of the convex base portion 107 extends along a plane (also referred to as a "horizontal plane") perpendicular to the vertical movement direction of the button portion 101, and the upper surface of the top wall 112 is formed with a slope portion 120 forming a predetermined angle with a horizontal plane. The slope portion 120 is inclined with respect to the horizontal plane, and the height of slope portion 120 along the vertical movement direction gradually decreases from the opening portions 113 side to the peripheral side (side wall 111 side) of top wall 112.

As illustrated in FIG. 7, the slope portions 120 are formed in a substantially square-shaped strip that surrounds the two opening portions 113. The slope portions 120 do not contact with the opening portions 113, and there is a predetermined gap between the slope portions and the opening portions.

Figure 9:
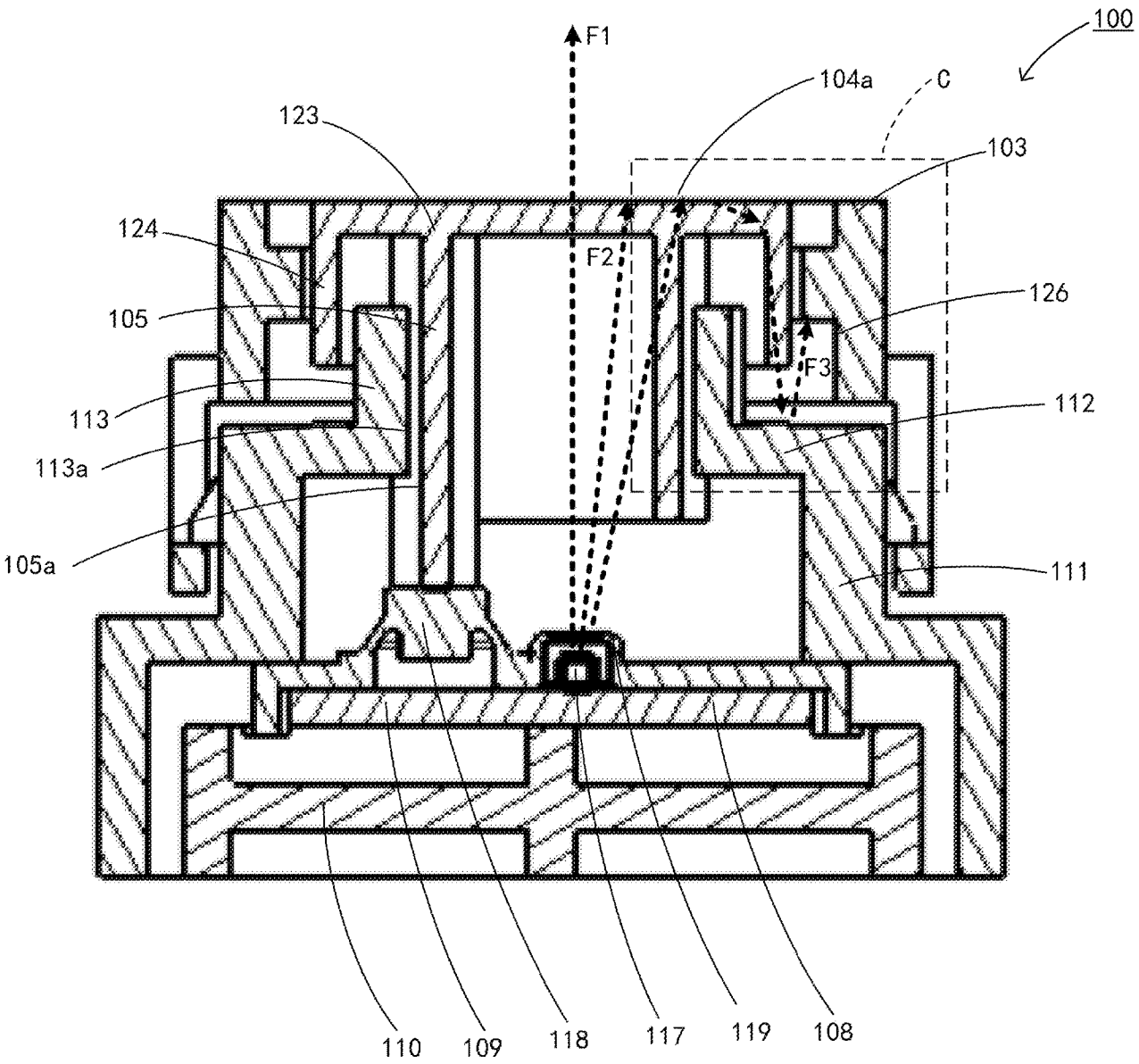
FIG. 9 is a cross-sectional view taken along plane B in FIGS. 4 and 5.
Figure 10:
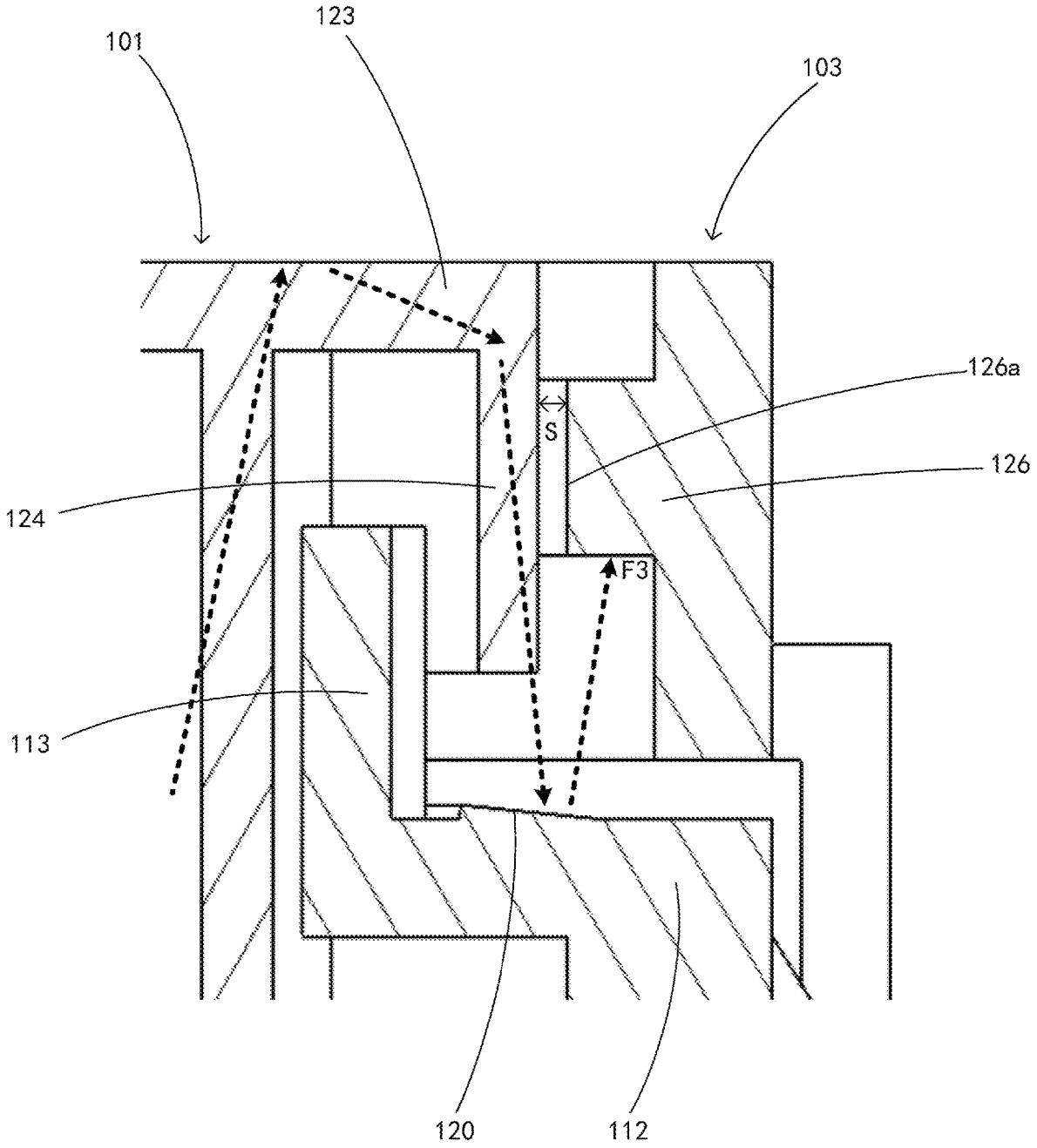
FIG. 10 is an enlarged view of a region C in FIG. 9.

Next, the internal structure of the illuminated push-button switch device 100 in the present embodiment and the propagation path of the light flux from the light source 117 will be described in detail with reference to FIGS. 9 and 10. FIG. 9 is a cross-sectional view taken along plane B in FIG. 4. FIG. 10 is an enlarged view of the region C in FIG. 9.

As illustrated in FIG. 9, the extending portion 105 is formed into a substantially tubular-shape that opens downwardly. The outer wall **105*a* of the extending portion 105 is in contact with at least a portion of the inner wall 113*a* of the opening portions 113 and is able to slide relatively along an opening direction (vertical direction) of the opening portions 113. This allows the button portion 101** to slide in vertical direction.

The light source 117 is situated directly under the extending portion 105 and, more precisely, within a protruding region formed in the circuit board 109 by protruding the extending portion 105 downwardly.

As also illustrated in FIG. 9, the operating portion 104 has a substantially flat top wall 123 and an outer wall 124 extending downwardly from the periphery of the top wall 123. In the button portion 101, a light shielding layer **104*a* is formed on almost the entire surface of the operating surface of the operating portion 104. In addition, by removing a portion of the light shielding layer 104*a* using a technique such as laser machining, a pattern (not illustrated) such as a number, for example, 1, 2, and 3, a figure, or the like, is formed on the surface of the operating portion 104. The light shielding layer 104*a*** is not formed in the position of these patterns (not illustrated).

In FIG. 9, the propagation path of the light flux from the light source 117 is also illustrated. When the light source 117 emits light, of the light emitted, the light F1 is emitted to the surface of the operating portion 104 and emits through a pattern (not illustrated), and of the light emitted, the light F2 is absorbed by the light shielding layer 104*a*. Of the light emitted, the light F3 that is not absorbed by the light shielding layer 104*a* is reflected by the upper surface of the top wall 112 of the light shielding layer 104*a* and the convex base portion 107 and then emits to the inner wall 126 of the panel portion 103 face toward the button portion 101.

FIG. 10 is an enlarged view of the region C in FIG. 9. As illustrated in FIG. 10, the gap S between the panel portion 103 and the button portion 101 is provided between the outer wall 124 of the operating portion 104 of the button portion 101 and the inner wall 126 of the panel portion 103. Specifically, the inner wall 126 of the panel portion 103 face to the button portion 101 has a convex edge 126*a* protruding toward the button portion 101. When viewed from above, the gap S between the panel portion 103 and the button portion 101 refers to the gap between the outer wall 124 and the convex edge 126*a*. In other words, the gap S in the present embodiment is the shortest distance between the panel portion 103 and the button portion 101 viewed from above.

The slope portion 120 is formed at a position situated under the gap S of the upper surface of the top wall 112 of the convex base portion 107. In other words, a portion of the upper surface of the top wall 112 becomes the slope portion 120. At least a portion of the slope portion 120 is positioned under the gap S. The slope portion 120 protrudes from the upper surface of top wall 112, the height of which gradually decreases from the button portion 101 side to the panel portion 103 side. The end of the slope portion 120 near the panel portion 103 is connected to the upper surface of the top wall 112, and the end of the slope portion 120 near the button portion 101 is situated directly under the outer wall 124 of the operating portion 104.

As illustrated in FIG. 10, some other light F3 that is not absorbed by the light shielding layer 104*a* is reflected by the light shielding layer 104*a* and then emits to the upper surface of the top wall 112. The light emission direction of the light F3 after being reflected by the slope portion 120 is inclined toward the panel portion 103 side because the slope portion 120 is provided on the upper surface of the top wall 112. Then, the light F3 emits to the inner wall 126 of the panel portion 103.

Hereinafter, a predetermined angle of the slope portion 120 will be described with reference to FIGS. 11 and 12.

Figure 11:
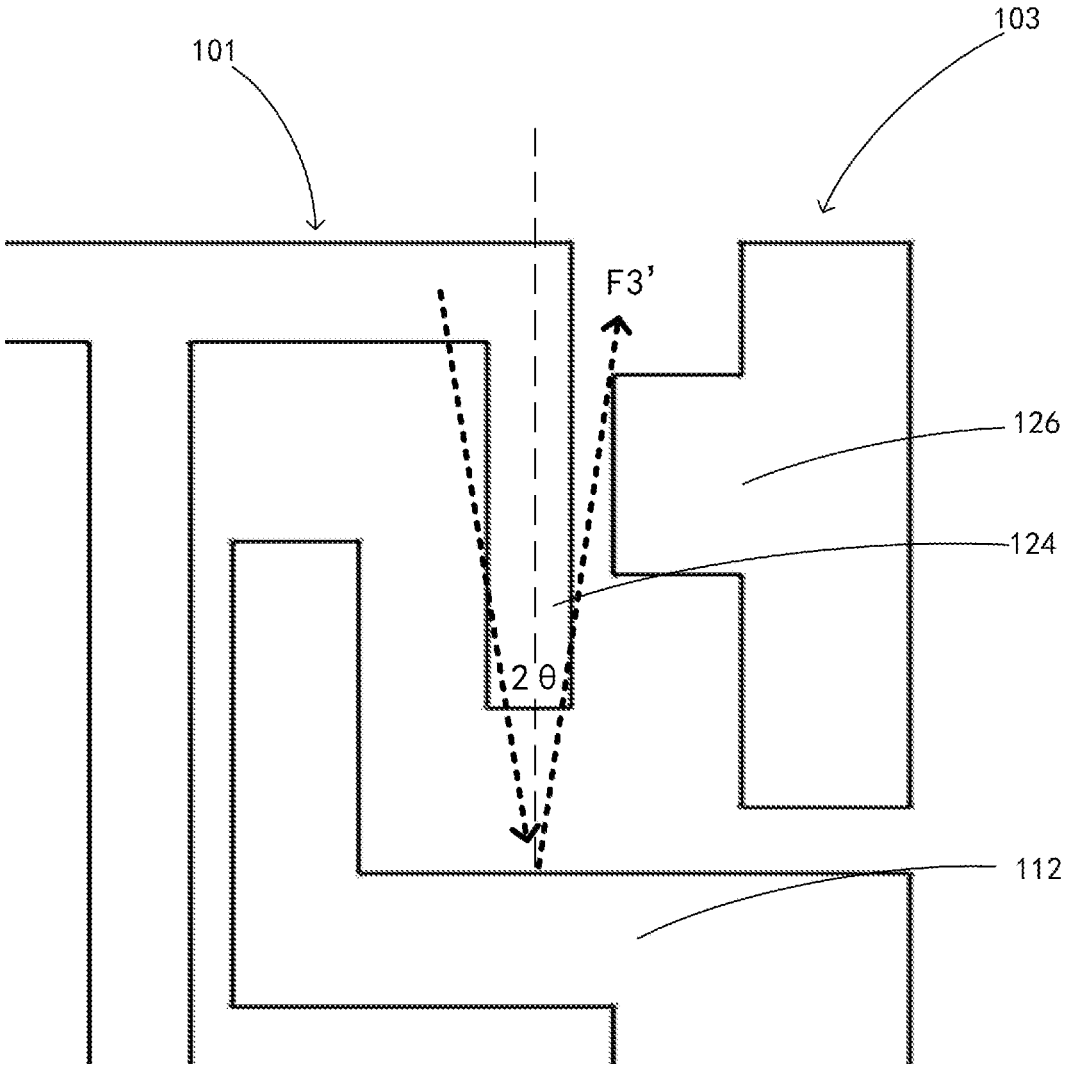
FIG. 11 is a diagram illustrating a propagation path of a light flux when a slope portion 120 is not provided.

FIG. 11 is a diagram of propagation path of the light flux when the slope portion 120 is not provided. For convenience of explanation, only the positional relationship between the button portion 101, the panel portion 103, and the top wall 112 is illustrated in FIG. 11.

When the slope portion 120 is not provided, among the light fluxes that can be directly emitted from the gap S after being reflected by the upper surface of the top wall 112, the light flux with the maximum angle of reflection (also referred to as "the light flux with maximum reflection angle") is a light flux in a direction of a straight line (tangent) that comes into contact with the inner wall 126 of the panel portion 103 via the lowermost end of the outer wall 124 of the button portion 101 (also referred to as "the light flux with maximum reflection angle"). As illustrated in FIG. 11, the angle of reflection (also referred to as the "the light flux with maximum reflection angle") of the maximum angle of reflection of light flux F3' at the upper surface of the top wall 112 is 2θ. The angle θ is the angle between the emission direction of the maximum angle of reflection of light flux F3' and the direction of the vertical line perpendicular to the upper surface of the top wall 112 (vertical direction). When the angle of reflection of the light flux is less than or equal to 2θ compared to the maximum angle of reflection of light flux F3', the light flux may be directly emitted from the gap S. Conversely, when the angle of reflection of the light flux is greater than 2θ, the light flux does not directly emit from the gap S, but emits to the lower end of the outer wall 124 or to the inner wall 126.

Figure 12:
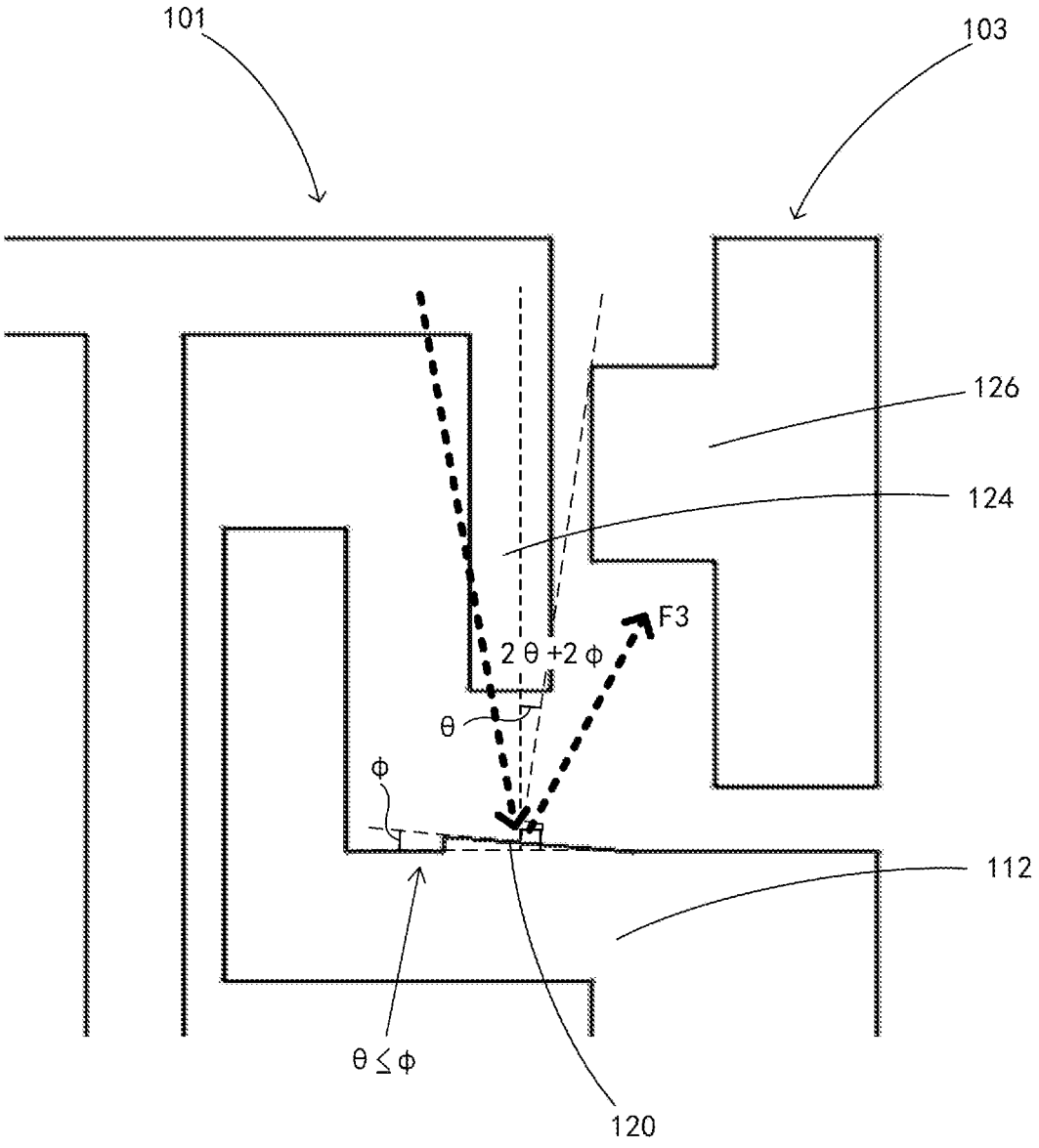
FIG. 12 is a diagram illustrating a propagation path of a light flux when a slope portion 120 with a predetermined angle θ1 is provided.

FIG. 12 is a diagram of propagation path of a light flux when a slope portion 120 is provided with a predetermined angle φ. For convenience of explanation, only the positional relationship between the button portion 101, the panel portion 103, and the top wall 112 is illustrated in FIG. 12.

When a slope portion 120 with a predetermined angle φ is provided, as can be seen from the geometric relationship, the angle of reflection increases by 2φ when the light flux F3 from the button portion 101 side is reflected by the slope portion 120. The predetermined angle φ is the angle (first angle) between the slope portion 120 and the upper surface (i.e., the horizontal plane) of the top wall 112. According to the geometric relationship, when the angle of incidence of the light flux F3 in FIG. 12 is the same as the angle of incidence of the light flux F3' in FIG. 11, the angle of reflection of the light flux F3 in the slope portion 120 is equal to 2θ+2φ.

When the first angle φ is set to be equal to or greater than the second angle θ, the angle at which the angle of reflection increases when the light flux F3 from the button portion 101 side is reflected by the slope portion 120 is equal to or greater than the maximum angle of reflection 2θ. The angle of reflection of these light fluxes is greater than the maximum angle of reflection 2θ.

Therefore, the light flux coming from the button portion 101 side and reflected by the slope portion 120 cannot be directly emitted from the gap. This allows the reflected light F3 to be reflected to the opaque area other than the gap S (the lower end of the outer wall 124 or the inner wall 126) to the maximum extent.

Hereinafter, the effect achieved by the present embodiment will be described.

With the configuration of the illuminated push-button switch device 100 described above, when the light F3 reflected by the light shielding layer 104*a* of the button portion 101 is emitted to the upper surface of the shell portion 102, the light F3 is reflected by the slope portion 120 which gradually decreases in height from the button portion 101 side to the panel portion 103, and then emits to the inner wall 126 of the panel portion 103 rather than the gap S between the panel portion 103 and the button portion 101. In other words, the emission direction of light that leak from the gap S between the panel portion 103 and the button portion 101 is inclined toward the panel portion 103 side by providing the slope portion 120. Such light is reflected by the inner wall 126 of the panel portion 103 multiple times, the amount of light emitted from the gap S can then be significantly reduced. Accordingly, the light flux F3 leaking from the gap S between the panel portion 103 and the button portion 101 is significantly reduced, so that the aesthetic property of the illuminated push-button switch device 100 can be improved.

The configuration of the illuminated push-button switch device 100 as described above prevents light from leaking through the panel portion 103 or the shell portion 102 from the light source 117 because the panel portion 103 and the shell portion 102 are formed by shaping an opaque material. In addition, the light emitted from the gap S between the panel portion 103 and the button portion 101 can be further reduced because light reflected by the slope portion 120 and then emitted to the panel portion 103 is reflected multiple times by the inner wall 126 formed by an opaque material, and some light is absorbed whenever the light is reflected.

In addition, most of the light leaking from the gap S between the panel portion 103 and the button portion 101 is reflected by a portion of the upper surface of the shell portion 102 situated directly under the gap S and then directly emits light from the gap S. By placing the slope portion directly under the gap, the reflected light can be emitted more efficiently at an oblique angle and the light leakage of the light flux F3 from the gap S between the panel portion 103 and the button portion 101 can be more reliably reduced.

In addition, as can be seen from the geometric relationship, when the slope portion 120 is provided and the first angle φ is equal to or greater than the second angle θ, the angle at which the angle of reflection increases when the light flux F3 from the button portion 101 side is reflected by the slope portion 120 is equal to or greater than the maximum angle of reflection 2θ. Therefore, the angle of reflection of the light flux F3 is greater than the maximum angle of reflection 2θ. Accordingly, the light flux F3 that comes from the button portion 101 side and is reflected by the slope portion 120 cannot be directly emitted from the gap S. This allows the reflected light to be reflected to the maximum extent to the opaque area other than the gap S.

Also, the slope portion 120 is integrally shaped with the shell portion 102 in the above-described illuminated push-button switch device 100. This allows a formation of the shell portion 102 at the same time of forming the slope portion 120 without complicating the machining process.

<Modification>

The above-described examples are preferred embodiments, the invention is not limited to such embodiments, and all modifications to the invention fall within the technical scope of the invention unless departing from the spirit of the invention.

Figure 13:
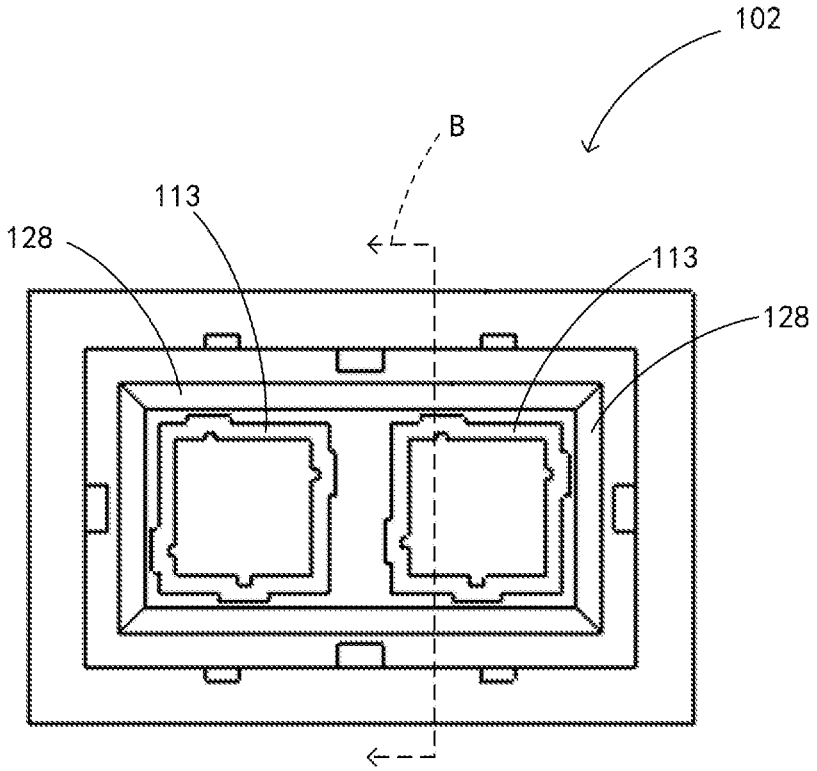
FIG. 13 is a top view of a shell portion in an alternative embodiment.
Figure 14:
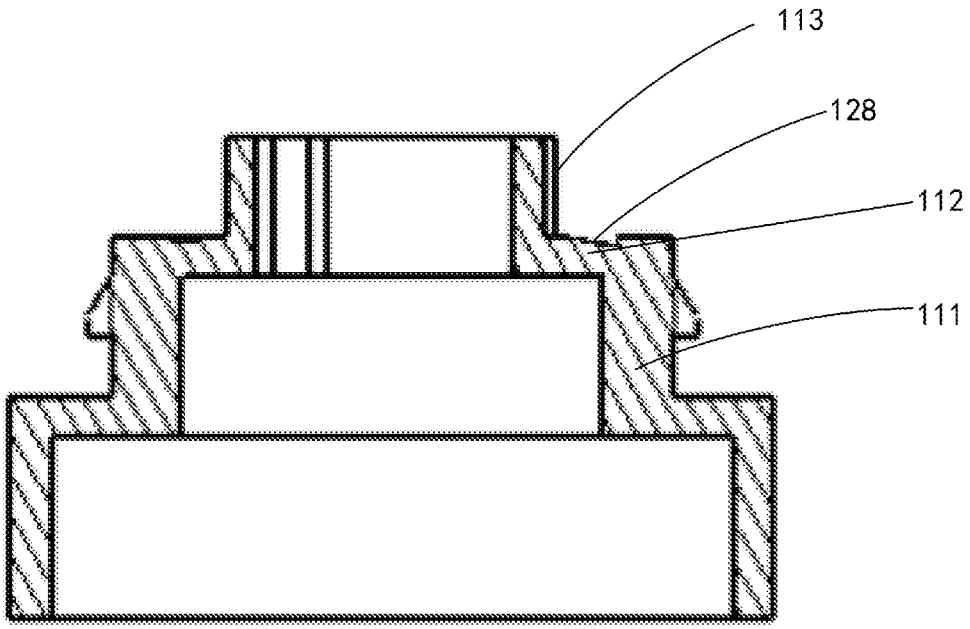
FIG. 14 is a cross-sectional view taken along plane B in FIG. 13.

In the illuminated push-button switch device 100 described above, the slope portion 120 is formed to protrude from the upper surface of the top wall 112 of the shell portion 102, but is not limited thereto. As illustrated in FIGS. 13 and 14, a slope portion 128 may be formed so as to be recessed from the upper surface of the top wall 112 of the shell portion 102 in the modification example of the present invention.

Thus, when the wall thickness of the upper surface of the top wall 112 is not enough, the slope portion may be in the form of a protruding shape protruding from the upper surface of the top wall 112 (see FIGS. 7 and 8). When the wall thickness of the upper surface of the top wall 112 is enough, the slope portion may be in the form of a shape recessing from the upper surface of the top wall 112 (see FIGS. 13 and 14).

In addition, when the slope portion having a protruded shape is provided, interference with the lower end of the outer wall 124 of the button portion 101 may occur, which may affect the sliding of the button portion 101. In such a case, a slope portion 128 in the form of a recessed shape is preferably provided.

Further, the end of the slope portion 120 near the button portion 101 may be directly connected to the opening portion 113, and the end of the slope portion 120 near the panel portion 103 may be directly connected to the side wall 111 of the convex base portion 107. In other words, the entire upper surface of the convex base portion 107 may be the slope portion 120.

Further, although the button portion 101 is formed by a translucent material, in practice, even when the button portion 101 is formed by an opaque material, the light leakage from the gap S can be reduced to a certain extent by providing the slope portion 120.

What is claimed is:

1. An illuminated push-button switch device comprising:

a shell portion enclosing a switch element and a light source and having one or more opening portions protruding from an upper surface of the shell portion;

a button portion provided to cover the one or more opening portions, the button portion being vertically movable along the one or more opening portions; and a panel portion surrounding an outside of the button portion and provided on the upper surface of the shell portion, wherein a gap is provided between the panel portion and the button portion in a top view, wherein the upper surface of the shell portion extends along a plane perpendicular to a vertical movement direction of the button portion, and a slope portion at a predetermined angle with respect to the upper surface is formed on a portion of the upper surface situated under the gap, wherein a height of the slope portion along the vertical movement direction gradually decreases from a button portion side to a panel portion side, wherein the slope portion is formed in a position that overlaps an entire circumference of an inner edge of the panel portion in a top view, and surrounds the one or more opening portions in a top view, and at least a portion of the slope portion is positioned directly under the gap, wherein a lower end of an outer wall of the button portion is provided parallel to the upper surface of the shell portion, and is at a predetermined angle with respect to the slope portion, the lower end facing the slope portion, wherein the gap is provided between an outer wall of the button portion and an inner wall of the panel portion facing the outer wall of the button portion, wherein a sloping angle of the slope portion with respect to the upper surface is defined as a first angle, wherein an angle between a direction of a tangent that comes into contact with the inner wall of the panel portion via a lowermost end of an outer surface of the outer wall of the button portion and a vertical direction perpendicular to the upper surface is defined as a second angle, wherein the first angle is greater than or equal to the second angle, and wherein a protrusion projecting toward the outer wall of the button portion is formed on the inner wall of the panel portion, and a distal end surface of the protrusion on the inner wall of the panel portion faces the outer surface of the outer wall of the button portion.

2. The illuminated push-button switch device according to claim 1, wherein the panel portion and the shell portion are formed by shaping an opaque material.

3. The illuminated push-button switch device according to claim 1, wherein the slope portion protrudes from the upper surface.

4. The illuminated push-button switch device according to claim 1, wherein the slope portion is integrally shaped with the shell portion.

* * * * *